US007204689B2

(12) United States Patent
Hashimoto et al.

(10) Patent No.: US 7,204,689 B2
(45) Date of Patent: Apr. 17, 2007

(54) SEAL STRUCTURE OF SOLID FEEDING SCREW, AND METHOD OF MANUFACTURING REDUCED METAL USING THE SEAL STRUCTURE

(75) Inventors: Sumito Hashimoto, Kobe (JP); Masahiko Tetsumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 51 days.

(21) Appl. No.: 10/542,637

(22) PCT Filed: Dec. 25, 2003

(86) PCT No.: PCT/JP03/16684

§ 371 (c)(1),
(2), (4) Date: Jul. 19, 2005

(87) PCT Pub. No.: WO2004/070301

PCT Pub. Date: Aug. 19, 2004

(65) Prior Publication Data

US 2006/0147866 A1 Jul. 6, 2006

(30) Foreign Application Priority Data

Feb. 5, 2003 (JP) ..... 2003-028658

(51) Int. Cl.
*F27B 7/24* (2006.01)

(52) U.S. Cl. ..... 432/115; 266/173; 277/903

(58) Field of Classification Search ..... 432/115; 266/173, 177; 277/358, 590, 903
See application file for complete search history.

(56) References Cited

U.S. PATENT DOCUMENTS 1,990,845 A * 2/1935 Thomas ..... 432/72
4,818,222 A 4/1989 Docherty et al.
6,251,161 B1 6/2001 Tateishi et al.
6,500,381 B1 12/2002 Harada
6,660,221 B2 12/2003 Urabe et al.
6,790,255 B2 * 9/2004 Hashimoto et al. ..... 75/484
6,814,924 B2 * 11/2004 Urabe et al. ..... 266/177

FOREIGN PATENT DOCUMENTS

| | | |
|---|---|---|
| EP | 1 277 844 A1 | 1/2003 |
| JP | 60-96597 | 7/1985 |
| JP | 60-104698 | 7/1985 |
| JP | 5-196363 | 8/1993 |
| JP | 9-217989 | 8/1997 |
| JP | 2001-304766 | 10/2001 |

* cited by examiner

*Primary Examiner*—Gregory Wilson
(74) *Attorney, Agent, or Firm*—Oblon, Spivak, McClelland, Maier & Neustadt, P.C.

(57) ABSTRACT

A sealing structure for a solid-transferring screw installed inside a heating furnace such as a material-leveling screw and a product-discharging screw, the sealing structure enabling the solid-transferring screw to be lifted during operation while airtightness of the heating furnace is retained. A driving shaft of the solid-transferring screw passes through through-holes formed in side walls of the heating furnace and is supported by liftable supporting devices disposed outside the furnace. Sealing blocks are attached on outer edges of the through-holes to surround the periphery of the through-holes at the outside of the furnace. Sliding panels are disposed at outer sides of the sealing blocks and have sliding holes for sliding the screw-driving shaft so that the driving shaft extends through the sliding holes. The sliding panels are brought into contact with the sealing blocks via the sealing members therebetween so that the sliding panels are slidable in the vertical direction.

13 Claims, 7 Drawing Sheets

SEAL STRUCTURE OF SOLID FEEDING SCREW, AND METHOD OF MANUFACTURING REDUCED METAL USING THE SEAL STRUCTURE

TECHNICAL FIELD

The present invention relates to a solid-transferring screw installed inside a heating furnace, and more particularly it relates to a sealing structure for the solid-transferring screw installed inside a movable hearth furnace for producing reduced iron by heating and reducing materials which are composed of iron oxide containing carbonaceous materials.

BACKGROUND ART

A movable hearth furnace (a heating furnace) is used for manufacturing a reduced metal (a product) by heating and reducing a metal oxide (a raw material) containing a carbonaceous reducing material. Such a movable hearth furnace has a leveling screw for laying the raw material evenly on the hearth of the movable hearth furnace and has a discharging screw for discharging the product from the furnace. When the thickness of the raw material is changed according to the conditions of the operation or when deposit on the hearth of the movable hearth furnace is removed, the leveling screw and the discharging screw are necessarily lifted during the operation.

In the case that the leveling screw and the discharging screw are installed inside the heating furnace, a driving device of the screws is generally arranged outside the furnace in order to protect the driving device from a high-temperature atmosphere of the heating furnace. Therefore, a hole is formed in a side wall of the heating furnace, and a driving shaft extends to the outside of the furnace through the hole. Since a gap formed between the hole and the driving shaft causes an outburst of atmosphere gas in the furnace or an incursion of the air into the furnace, a sealing structure for preventing the problems is required.

When such a screw type device is provided with a lifting device, the relative position between the hole and the driving shaft is changed by lifting the screws. Therefore, the sealing structure should be able to follow the change in the relative position between the hole and the driving shaft.

In some cases, the leveling screw having the lifting device and the discharging screw having the lifting device in the furnace may be supported by the lifting device installed outside the furnace so as to be liftable. However, in such a structure, the hole formed in the side wall of the heating furnace and the driving shaft of the screw cannot be moved in the vertical direction and the mechanism for lifting the screw during an operation is not disclosed.

DISCLOSURE OF INVENTION

It is an object of the present invention to provide a sealing structure for a solid-transferring screw disposed in a heating furnace such as a material-leveling screw or a product-discharging screw, wherein the solid-transferring screw is liftable during the operation while the airtightness of the heating furnace is retained, and to provide a method for producing a reduced metal by using the sealing structure.

A first aspect of the present invention relates to a sealing structure which seals gaps between a heating furnace for heating a solid material and a liftable solid-transferring screw extending through side walls of the heating furnace, wherein the solid-transferring screw has a driving shaft substantially horizontally arranged and a helical blade fixed on the driving shaft; the driving shaft passes through through-holes for screw-driving shaft which are formed in side walls of the heating furnace, each of the through-holes having a vertical size which is larger than the diameter of the driving shaft by at least a lifting range of the solid-transferring screw, the driving shaft being supported by liftable supporting devices which are disposed at the outsides of the heating furnace; sealing blocks are attached on the outer edges of the through-holes for screw-driving shaft so as to surround the periphery of the through-holes at the outsides of the heating furnace; and sliding panels are disposed at the outer sides of the sealing blocks of the furnace, each of the sliding panels having a sliding hole for sliding the screw-driving shaft so that the driving shaft extends through the sliding hole, each of the sliding panels being slidable in the vertical direction while airtightness between the sliding panel and the sealing block is retained.

In this aspect, since airtightness between the sealing blocks and the sliding panels can be retained when their relative vertical positions change, the structure can be applied to a solid-transferring screw which moves in a relatively large range.

A second aspect of the present invention relates to the sealing structure for the solid-transferring screw described in the first aspect, further including at least one sealing member that surrounds the driving shaft between the corresponding sealing block and the corresponding sliding panel, wherein the sliding panel is brought into contact with the sealing block with the sealing member therebetween.

In this aspect, since the sealing block and the sliding panel do not come into direct contact with each other, wear in these parts is reduced and the airtightness (sealing) can be retained even when a gap is formed between these parts by thermal deformation of the sealing block and/or the sliding panel.

A third aspect of the present invention relates to the sealing structure for the solid-transferring screw described in the first aspect, further including sealing devices for sealing gaps between the driving shaft and the sliding holes for sliding the screw-driving shaft.

In this aspect, higher airtightness between the sliding holes for sliding the screw-driving shaft and the driving shaft is secured.

A fourth aspect of the present invention relates to the sealing structure for the solid-transferring screw described in the first aspect, further including lifting members and couplers disposed at the outsides of the heating furnace, wherein each of the lifting members is fixed on the corresponding supporting device and cooperatively moves up and down with the supporting device, and each of the couplers connects the corresponding lifting member and the corresponding sliding panel.

In this aspect, since the sliding panels are supported by the lifting members via the couplers and move up and down, the sliding panels do not apply weights on the driving shaft of the solid-transferring screw and on the sealing members. As a result, wear of the driving shafts and the sealing members is reduced and adequate airtightness is secured.

A fifth aspect of the present invention relates to the sealing structure for the solid-transferring screw described in the fourth aspect, wherein each of the couplers is pivoted to the corresponding lifting member and the corresponding sliding panel.

In this aspect, even when the solid-transferring screw is lifted and the driving shaft inclines from the horizontal position, the couplers are moved by the lifting members and the sliding panels. Therefore, the contact between the sliding panels and the sealing blocks via the sealing members is securely retained.

A sixth aspect of the present invention relates to the sealing structure for the solid-transferring screw described in the third aspect, wherein the sealing devices and the sliding panels are connected with respective expansion joints.

In this aspect, even when the driving shaft of the solid-transferring screw largely inclines from the horizontal position during the operation, the misalignment of the driving shaft and the sealing devices is absorbed by deforming the expansion joints. Therefore, good airtightness is secured.

A seventh aspect of the present invention relates to the sealing structure for the solid-transferring screw described in the first aspect, further including biasing devices for biasing the sliding panels to the sealing blocks.

In this aspect, better airtightness between the sliding panels and the sealing blocks is achieved.

An eighth aspect of the present invention relates to the sealing structure for the solid-transferring screw described in the second aspect, wherein two or more sealing members are provided and at least one inert-gas suction channel for injecting inert gas is disposed between these sealing members.

In this aspect, when the sealing member arranged at the inner side of the furnace is deteriorated from heat, dust, and the like, the sealing member is protected by the blowing inert gas. Therefore, reliable airtightness is provided.

A ninth aspect of the present invention relates to the sealing structure for the solid-transferring screw described in the first aspect, wherein each of the sliding panels includes a combination of a plurality of sliding panel members so that the solid-transferring screw can be detached from the furnace by removing a part of the sliding panel members.

In this embodiment, since the maintenance of the solid-transferring screw can be performed without difficulty, the working hours are reduced and the operating rate is increased.

A tenth aspect of the present invention relates to the sealing structure for the solid-transferring screw described in the fourth or fifth aspect, wherein the lifting members disposed at the outsides of the heating furnace are integrated with each other.

In this aspect, the driving shaft of the solid-transferring screw and the supporting devices arranged at the outsides of the furnace cooperatively move. Therefore, even when the driving shaft inclines from the horizontal position, the supporting devices of the driving shaft are not extraordinarily loaded.

An eleventh aspect of the present invention relates to a method for producing a reduced metal by heating and reducing a metal oxide containing a carbonaceous reducing material, the method including the steps of feeding the metal oxide into a heating furnace for heating the metal oxide; leveling the metal oxide fed into the heating furnace in the feeding step with a material-leveling screw; and heating the metal oxide evenly laid in the leveling step for reducing; wherein the material-leveling screw includes a driving shaft and a helical blade fixed on the driving shaft; the driving shaft passes through through-holes for screw-driving shaft which are formed in the side walls of the heating furnace, each of the through-holes having a vertical size which is larger than the diameter of the driving shaft by at least a lifting range of the material-leveling screw, the driving shaft being supported by liftable supporting devices which are disposed at the outsides of the heating furnace; sealing blocks attached on the outer edges of the through-holes for the screw-driving shaft so as to surround the periphery of the through-holes at the outsides of the heating furnace; and sliding panels are disposed at the outer sides of the sealing blocks of the furnace, each of the sliding panels having a sliding hole for sliding a screw-driving shaft so that the driving shaft extends through the sliding hole, each of the sliding panels being slidable in the vertical direction while airtightness between the sliding panel and the sealing block is retained.

A twelfth aspect of the present invention relates to a method for producing a reduced metal by heating and reducing a metal oxide containing a carbonaceous reducing material, the method including the steps of feeding the metal oxide into a heating furnace for heating the metal oxide; heating the metal oxide fed into the heating furnace in the feeding step for reducing; and discharging the resulting reduced metal in the heating step with a product-discharging screw; wherein the product-discharging screw includes a driving shaft and a helical blade fixed on the driving shaft; the driving shaft passes through through-holes for screw-driving shaft which are formed in the side walls of the heating furnace, each of the through-holes having a vertical size which is larger than the diameter of the driving shaft by at least a lifting range of the product-discharging screw, the driving shaft being supported by liftable supporting devices which are disposed at the outsides of the heating furnace; sealing blocks are attached on the outer edges of the through-holes for the screw-driving shaft so as to surround the periphery of the through-holes at the outsides of the heating furnace; and sliding panels are disposed at the outer sides of the furnace, each of the sliding panels having a sliding hole for sliding the screw-driving shaft so that the driving shaft extends through the sliding hole, each of the sliding panels being slidable in the vertical direction while airtightness between the sliding panel and the sealing block is retained.

The raw-material-leveling screw and/or the product-discharging screw can be readily lifted during the operation, while the production of reduced metals can be continued. Therefore, raw materials can be evenly dispersed on the hearth and the reduced metals can be stably discharged. Since deposit on the hearth can be reliably removed, the operation can be stabilized over a long period of time.

As described above, the present invention provides a sealing structure which can lift a solid-transferring screw during the operation while the airtightness of the heating furnace is retained. In a process to produce a reduced metal, the application of the sealing structure of the present invention to the material-leveling screw and/or the product-discharging screw is highly safe because gas leakage from the furnace is prevented, and the operation with high energy efficiency can be constantly conducted for many hours because air is prevented from penetrating into the furnace.

BEST MODE FOR CARRYING OUT THE INVENTION

The embodiments according to the present invention will now be described with reference to the drawings.

[First Embodiment]

Figure 1B:
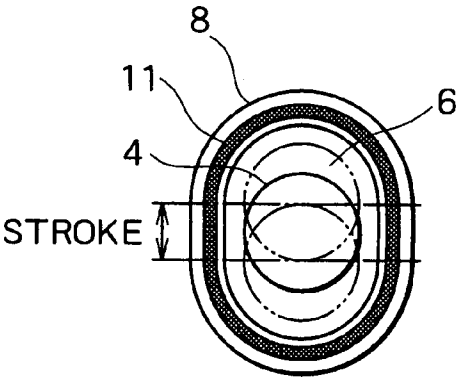
FIG. 1(*a*) is a partial vertical sectional view of a sealing structure for a solid-transferring screw according to a first embodiment of the present invention, FIG. 1(*b*) is a sectional view taken along line A—A in FIG. 1(*a*), and FIG. 1(*c*) is a sectional view taken along line B—B in FIG. 1(*a*).
Figure 1C:
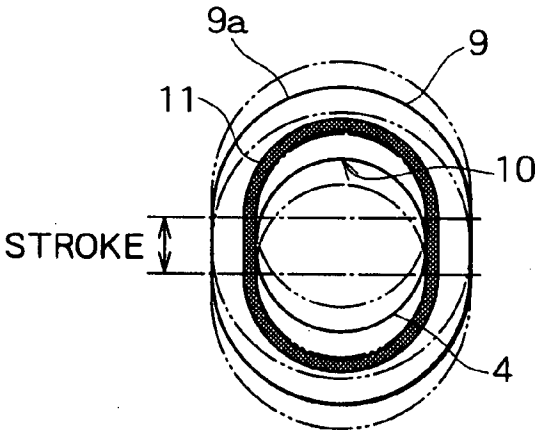
Figure 1A:
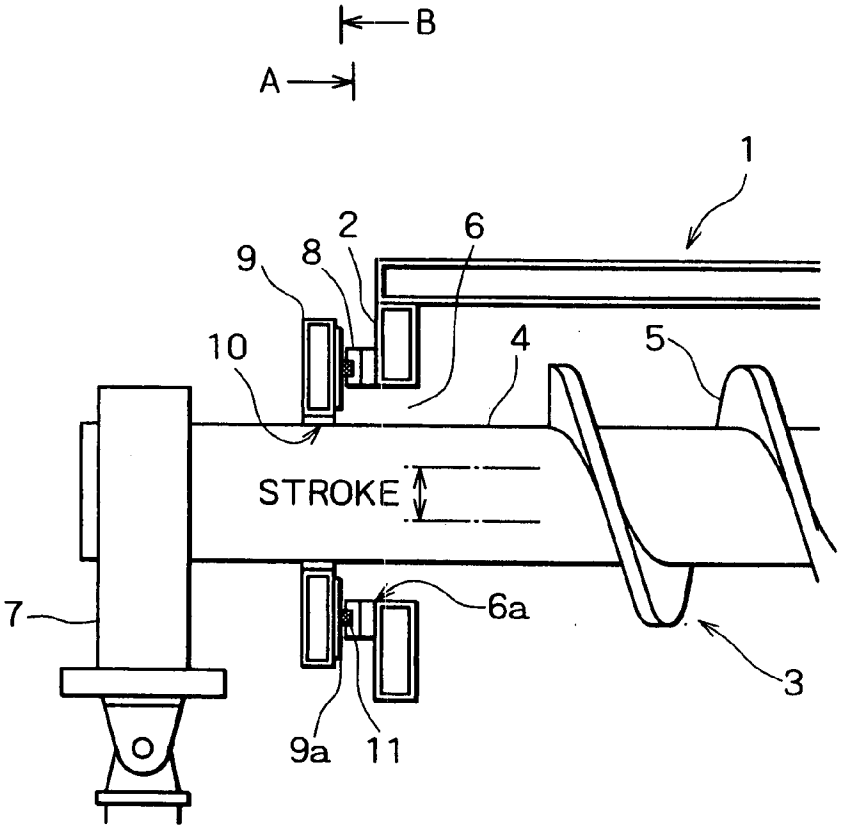

FIG. 1 illustrates a sealing structure for a solid-transferring screw according to a first embodiment of the present invention. Here, the reference numerals are designates as follows: 1 for a heating furnace; 2 for a side wall of the heating furnace 1; 3 for a solid-transferring screw; 4 for a driving shaft of the solid-transferring screw 3; 5 for a helical blade of the solid-transferring screw 3; 6 for a through-hole for a screw-driving shaft in the side wall 2; 7 for a supporting device; 8 for a sealing block; 9 for a sliding panel; 10 for a sliding hole for sliding a screw-driving shaft in the sliding panel 9; and 11 for a sealing member.

Preferably, types of the heating furnace 1 to which the present invention is applied include, but are not limited to, a movable hearth furnace such as a rotary-hearth furnace for heating particulate or massive solid materials. For example, the present invention can be applied to a method for producing a reduced metal (product) such as reduced iron by feeding metal oxide (raw material) agglomerates such as iron oxide containing coal as a carbonaceous reducing material or supplying the raw material without the agglomeration to the heating furnace 1 and by heating and reducing the raw material in the heating furnace 1. In the method for producing the reduced metal in the heating furnace 1, the solid-transferring screw 3 has a leveling function for dispersing the raw material on the hearth evenly when the raw material is fed in the heating furnace 1 and has a discharging function for discharging the product on the hearth. During the operation of the solid-transferring screw 3, the solid-transferring screw 3 must be liftable while the airtightness (sealing) between the solid-transferring screw and the heating furnace 1 is retained.

Since the sealing structure of the heating furnace 1 according to this embodiment has the same structure at both sides in the axial direction of the screw, FIGS. 1 to 8 show the structure at one side wall 2 of the heating furnace 1 (i.e. the left side in FIG. 1(*a*)).

As shown in FIG. 1(*a*), a through-hole 6 for a screw-driving shaft is provided in the side wall 2 of the heating furnace 1. The solid-transferring screw (or referred to as simply "screw", hereinafter) 3 extends through the through-hole 6 of the side wall 2. The screw 3 is composed of a substantially horizontal driving shaft 4 and a helical blade 5 fixed on the driving shaft 4. The driving shaft 4 passes through the through-hole 6 in the side walls 2 and the protruding ends of the shaft protruding from the side walls 2 are supported by respective liftable supporting devices 7 disposed at the outsides of the heating furnace 1. Each of the supporting devices 7 has a shaft bearing (not shown) for supporting the driving shaft 4. The supporting devices 7 are operated by power such as oil pressure, water pressure, and electricity to lift the driving shaft 4.

The through-hole 6 for the screw-driving shaft has a vertical size which is larger than the diameter of the driving shaft 4 by at least a lifting range of the screw 3 (a stroke in the vertical direction), so that the screw 3 (the driving shaft 4) can be lifted in the predetermined range.

As shown in FIG. 1(*b*), a sealing block 8 is attached on the outside edge 6*a* of the through-hole 6 for the screw-driving shaft so as to surround the periphery of the through-hole 6. A sliding panel 9 is disposed at the outer side of the sealing block 8 of the furnace. The sliding panel 9 has a sliding hole 10 for sliding the screw-driving shaft so that the driving shaft 4 extends through the sliding hole. The inner diameter of the sliding hole 10 for sliding the screw-driving shaft is slightly larger than the outer diameter of the driving shaft 4 to help the rotation of the driving shaft 4.

As shown in FIG. 1(*a*), the sealing block 8 has a groove on the outer face for attaching (fitting) a sealing member 11 composed of, for example, a ring heat-resistant gland packing, and the sealing member 11 is fitted into the groove. The groove surrounds the sliding hole 10 for sliding the screw-driving shaft, for example, in an elliptic form. The sliding panel 9 is biased against the sealing block 8 where the sealing member 11 is attached so that the sliding panel 9 is brought into contact with the sealing block 8 and is still slidable in the vertical direction. As long as the sealing member 11 can be fixed and the sealing between the sealing block 8 and the sliding panel 9 is retained, methods for attaching the sealing member 11 to the sealing block 8 or to the sliding panel 9 are not limited to the methods for fitting the sealing member 11 into the groove, and the groove may not be formed.

The sliding panel 9 maintains the contact with the whole area of the ring sealing member 11 during the sliding in the vertical direction. Consequently, as shown in FIG. 1(*c*), the sliding panel 9 must have a sufficient size which is larger than the stroke in the vertical direction.

To prevent thermal deformation of the sealing block 8, the portion surrounding the through-hole 6 for the screw-driving shaft on the side wall 2 of the heating furnace 1 preferably has a heat insulating structure formed of a refractory material, a heat insulating material, and the like or has a water-cooling panel system. The sliding panel 9 preferably has an internal water-cooling system in order to prevent a decrease in sealing performance which is caused by thermal distortion of a contacting face 9*a* of the sliding panel 9 to the sealing member 11.

As shown in FIG. 1(*b*), in this embodiment, one (single) ring sealing member 11 is attached to the sealing block 8. However, a multiple sealing structure including two or more sealing members 11 fitted into the sealing block 8 may be employed in order to make the sealing (airtightness) secured.

In this embodiment, the sealing member 11 is attached to the sealing block 8. Alternatively, the sealing member 11 may be attached to the sliding panel 9. When the sealing member 11 is attached to the sliding panel 9, the sealing member 11 moves in cooperation with the sliding of the sliding panel 9 in the vertical direction. Consequently, the sealing block 9 must be large enough in the vertical direction to retain the contact with the overall area of the sealing member 11. Therefore, the sealing member 11 attached to the sealing block 8 as shown in this embodiment is preferable from the viewpoint of cost.

In this embodiment, the sealing member 11 is arranged between the sealing block 8 and the sliding panel 9. However, when the pressure and temperature in the furnace are not so high and adequate sealing is retained by a mere contact between the sealing block 8 and the sliding panel 9, the sealing member 11 is not indispensable.

Since the sealing structure for the solid-transferring screw 3 according to the embodiment allows the relative position between the sealing block 8 and the sliding panel 9 to change in the vertical direction while retaining the airtightness, the solid-transferring screw 3 can move in a relatively large range. The sealing structure enables the operation of the furnace for a long time with high safety without leakage of gas from the inside of the furnace and with high efficiency without air flow into the furnace.

Since the raw-material-leveling screw and/or the product-discharging screw can be easily lifted during the operation, producing reduced metals can be continued. Therefore, raw materials can be evenly dispersed on the hearth and the reduced metals can be stably discharged. Since deposit on the hearth can be reliably removed, a stable operation over a long time is possible.

In this embodiment, since the sealing member 11 is interposed between the sealing block 8 and the sliding panel 9, the sealing block 8 and the sliding panel 9 do not directly come into contact with each other. Consequently, wear in these parts is reduced and adequate sealing can be retained even when a gap is formed between these parts by thermal deformation of the sealing block 8 and/or the sliding panel 9.

[Second Embodiment]

Figure 2:
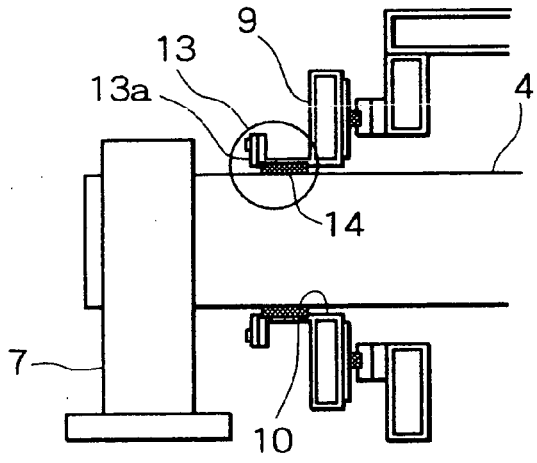
FIG. 2 is a partial vertical sectional view of a sealing structure for a solid-transferring screw according to a second embodiment of the present invention.

FIG. 2 illustrates a sealing structure for the solid-transferring screw 3 according to a second embodiment of the present invention. In a sealing device 13 of the second embodiment, the gap between the sliding hole 10 for sliding the screw-driving shaft and the driving shaft 4 of the screw 3 in the first embodiment is sealed with a shaft-sealing member 14.

As described in the first embodiment, when the inner diameter of the sliding hole 10 for sliding the screw-driving shaft is slightly larger than the diameter of the driving shaft 4 of the screw 3 to help the rotation of the driving shaft 4, the airtightness (sealing) is substantially secured. When tighter sealing is required, for example, when the difference in pressure between the inside of the furnace and the atmosphere is large, the sealing device 13 shown in FIG. 2 is preferable.

As shown in FIG. 2, the sealing device 13 includes, for example, the shaft-sealing member 14, such as a cylindrical gland packing and a V ring, and a supporting member 13*a* for supporting the shaft-sealing member 14. The shaft-sealing member 14 has an inner diameter to help the rotation of the driving shaft 4 and has a thickness so as to seal the gap between the sliding hole 10 for sliding the screw-driving shaft and the driving shaft 4. The space through which the shaft-sealing member 14 extends is smaller stepwise toward the inner end (toward the inside of the furnace) and the supporting member 13*a* blocks the outer end of the shaft-sealing member 14 not to protrude from the inner end of the gap (the inside of the furnace), so that the shaft-sealing member 14 does not deviate in the axial direction of the driving shaft 4 by the rotation of the driving shaft 4.

In this embodiment, the sealing device 13 ensures the airtightness between the sliding hole 10 for sliding the screw-driving shaft and the driving shaft 4, and adequate sealing is retained even when a large difference occurs in the pressure between the inside of the furnace and the atmosphere.

Other structures, functions, and advantages are the same as those in the first Embodiment.

[Third Embodiment]

Figure 3:
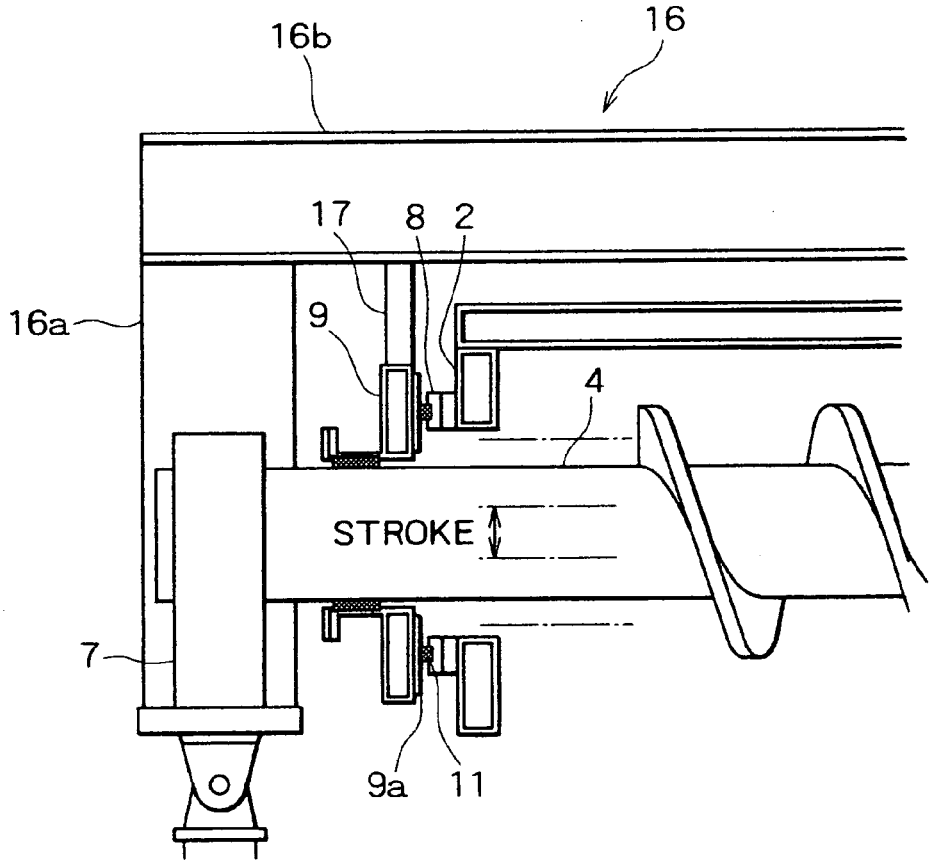
FIG. 3 is a partial vertical sectional view of a sealing structure for a solid-transferring screw according to a third embodiment of the present invention.

FIG. 3 illustrates a sealing structure for the solid-transferring screw 3 according to a third embodiment of the present invention. The third embodiment is different from the second embodiment in that a lifting member 16, which is fixed to the supporting device 7 and moves up and down together with the supporting device 7, and a coupler 17, which connects the lifting member 16 to the sliding panel 9, are provided.

As shown in FIG. 3, the lifting member 16 includes, for example, a frame consisting of a longitudinal member 16*a* and a transverse member 16*b*. The transverse member 16*b* is arranged above the heating furnace 1, the longitudinal member 16*a* is arranged at the side of the heating furnace 1, and both the longitudinal member 16*a* and the transverse member 16*b* are connected together. The longitudinal member 16*a* is fixed to the supporting device 7.

The coupler 17 is fixed to the transverse member 16*b* and extends downward. The sliding panel 9 is suspended from the bottom end of the coupler 17. The length of the coupler 17 is determined so that the sliding panel 9 does not load the driving shaft 4 with its weight.

In this embodiment, since the sliding panel 9 is supported by the lifting member 16 via the coupler 17 and moves up and down in this supported state, the sliding panel 9 does not load the driving shaft 4 of the solid-transferring screw 3 and the sealing member 11 with its weight. As a result, wear of the driving shaft 4 and the sealing member 11 is reduced and adequate sealing is secured.

Other structures, functions, and advantages are the same as those in the second embodiment.

[Fourth Embodiment]

Figure 4:
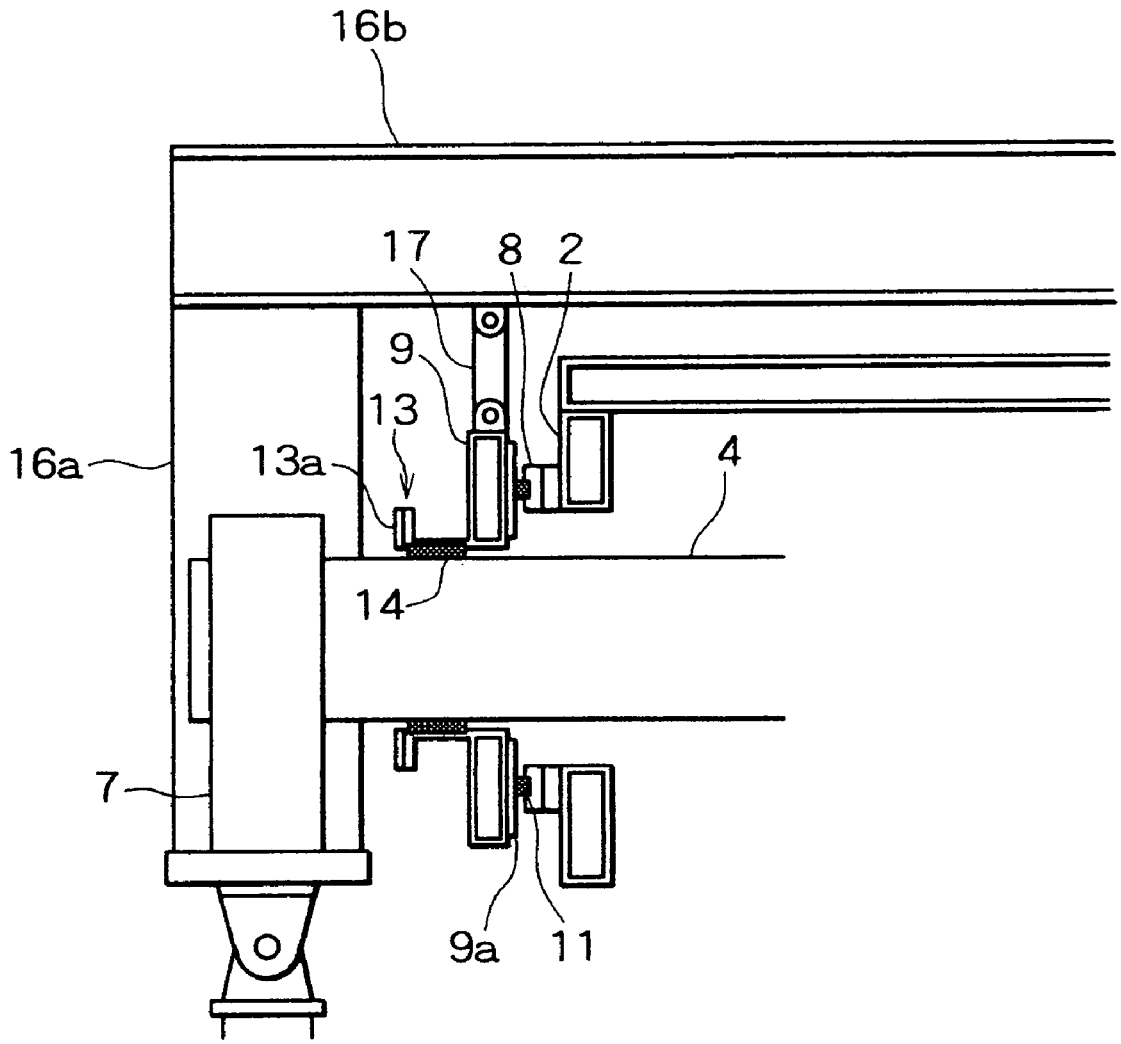
FIG. 4 is a partial vertical sectional view of a sealing structure for a solid-transferring screw according to a fourth embodiment of the present invention.

FIG. 4 illustrates a sealing structure for the solid-transferring screw 3 according to a fourth embodiment of the present invention. In the third embodiment, the coupler 17 has a rigid integrated structure. In the fourth embodiment, the coupler 17 is pivoted to both the lifting member 16 and the sliding panel 9 with hinged joints. The upper end of the coupler 17 is pivoted to the transverse member 16*b* of the lifting member 16 and the bottom end of the coupler 17 is pivoted to the sliding panel 9.

In the structure shown in FIG. 3 according to the third embodiment, the lifting member 16 and the sliding panel 9 incline through the coupler 17 while the driving shaft 4 inclines from the horizontal position. However, the sealing block 8 does not incline because it is fixed on the side wall 2 of the heating furnace. As a result, a gap may be easily formed between the sealing member 11 of the sealing block 8 and the contacting face 9*a* of the sliding panel 9 and adequate sealing may not be achieved.

On the other hand, in this fourth embodiment as shown in FIG. 4, the incline of the lifting member 16 does not affect the coupler 17 because of the hinged joints. Therefore, the contacting face 9*a* of the sliding panel 9 moves independently with respect to the driving shaft 4 when the driving shaft 4 inclines, and the airtightness between the contacting face 9*a* and the sealing member 11 is constantly secured. As a result, even when the driving shaft 4 inclines from the horizontal position according to the lift of the solid-transferring screw 3, adequate sealing between the sealing member 11 and the contacting face 9*a* of the sliding panel 9 can be highly secured.

Other structures, functions, and advantages are the same as those in the third Embodiment.

[Fifth Embodiment]

Figure 5:
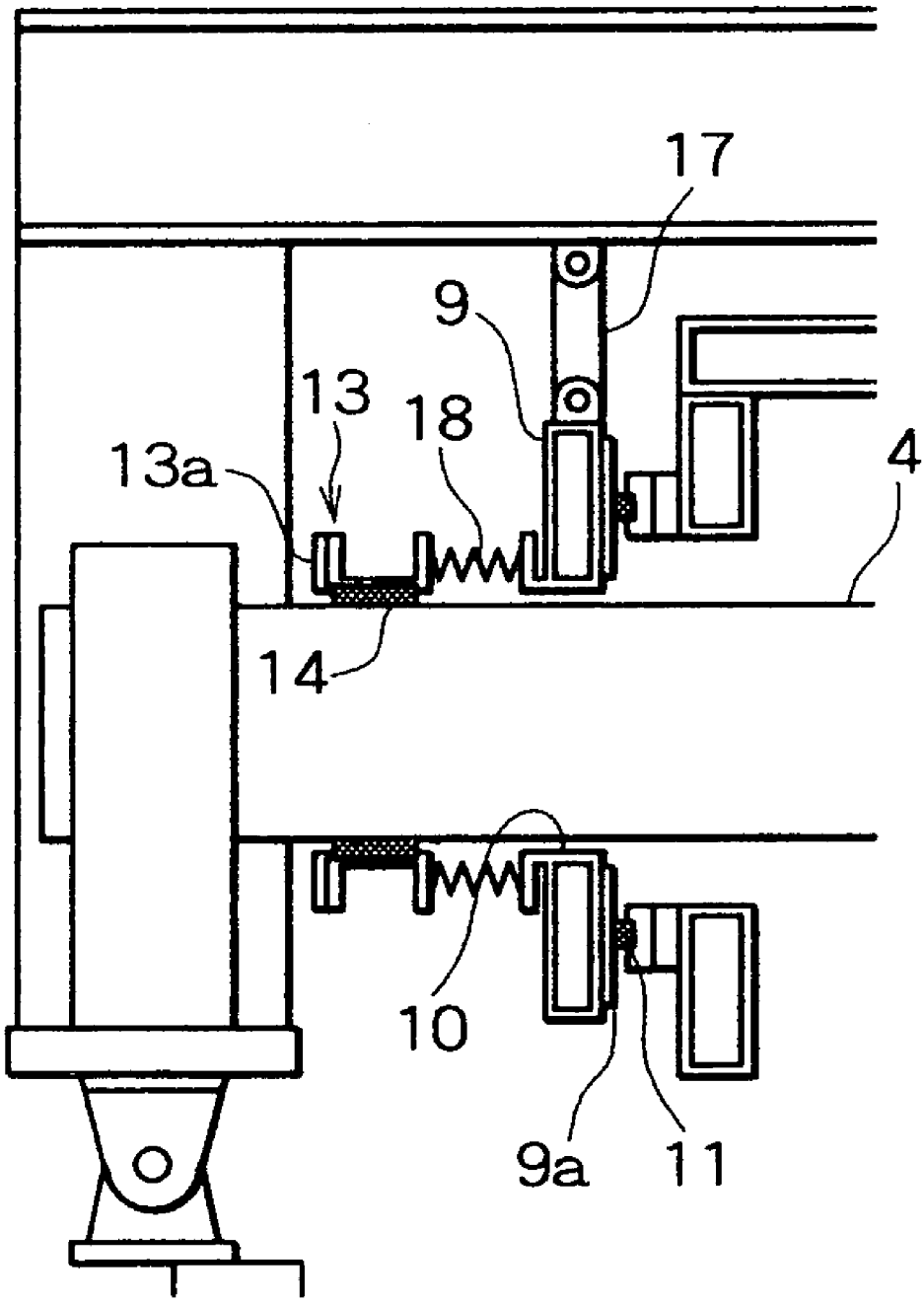
FIG. 5 is a partial vertical sectional view of a sealing structure for a solid-transferring screw according to a fifth embodiment of the present invention.

FIG. 5 illustrates a sealing structure for the solid-transferring screw 3 according to a fifth embodiment of the present invention. In the fourth embodiment, the sealing device 13 is directly fixed along the sliding hole 10 for sliding the screw-driving shaft of the sliding panel 9. In this fifth embodiment, the sealing device 13 is connected to the sliding panel 9 with an expansion joint 18.

In the structure shown in FIG. 4 according to the fourth embodiment, the sliding panel 9 is pivoted to the lifting member 16 via the coupler 17 and the supporting member 13*a* of the sealing device 13 is fixed directly to the sliding panel 9. Consequently, even when the driving shaft 4 inclines from the horizontal position, the contacting face 9*a* of the sliding panel 9 does not substantially incline and the sealing device 13 substantially does not incline. As a result, when the driving shaft 4 inclines, misalignment of the center occurs between the sealing device 13 and the driving shaft 4. When an incline angle of the driving shaft 4 from the horizontal position is comparatively small, the shaft-sealing member 14 deforms to absorb the misalignment of the center, and adequate sealing between the sliding panel 9 and the driving shaft 4 is retained. However, when the incline angle is large, the shaft-sealing member 14 cannot absorb the misalignment of the center because of the limitation in the acceptable deforming range of the shaft-sealing member 14. As a result, the driving shaft 4 may be excessively loaded.

On the other hand, in this embodiment as shown in FIG. 5, since the sealing device 13 and the sliding panel 9 are connected with the retractable expansion joint 18, the misalignment of the center can be absorbed by deforming the expansion joint 18 even when the incline angle is large. Therefore, the airtightness is highly improved. Furthermore, the driving shaft 4 can avoid being excessively loaded.

When the driving shaft 4 rotates, sliding friction of the sealing device 13 causes torsion of the expansion joint 18. This may damage the expansion joint 18. Therefore, an absorber (not shown) for the sliding friction is preferably mounted between the sliding panel 9 and the sealing device 13 so that the torsion is not directly generated on the expansion joint 18.

Other structures, functions, and advantages are the same as those in the fourth Embodiment.

[Sixth Embodiment]

Figure 6:
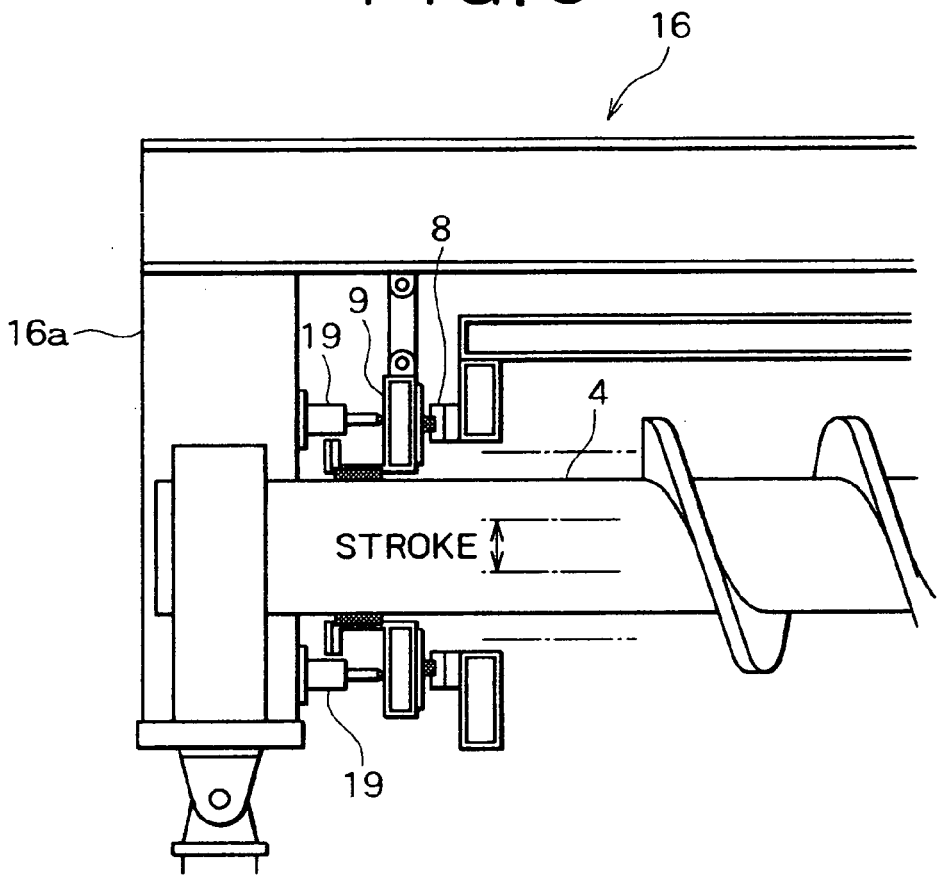
FIG. 6 is a partial vertical sectional view of a sealing structure for a solid-transferring screw according to a sixth embodiment of the present invention.

FIG. 6 illustrates a sealing structure for the solid-transferring screw 3 according to a sixth embodiment of the present invention. In this sixth embodiment, a biasing device 19 for biasing the sliding panel 9 to the sealing block 8 is provided.

As shown in FIG. 6, the biasing device 19 is, for example, fixed to the longitudinal member 16*a* of the lifting member 16. The biasing device 19 biases a face, which faces the furnace, of the sliding panel 9 to the sealing block 8 by using a motive power such as hydraulic pressure and air pressure or a spring force such as a spring (not shown). Preferably, a plurality of biasing device 19 surrounds the driving shaft 4 so that the sliding panel 9 is equally biased against the sealing block 8.

In this sixth embodiment, since the biasing device 19 is provided for biasing the sliding panel 9 to the sealing block 8, the higher airtightness between the sliding panel 9 and the sealing block 8 is secured.

Other structures, functions, and advantages are the same as those in the third Embodiment.

[Seventh Embodiment]

Figure 7:
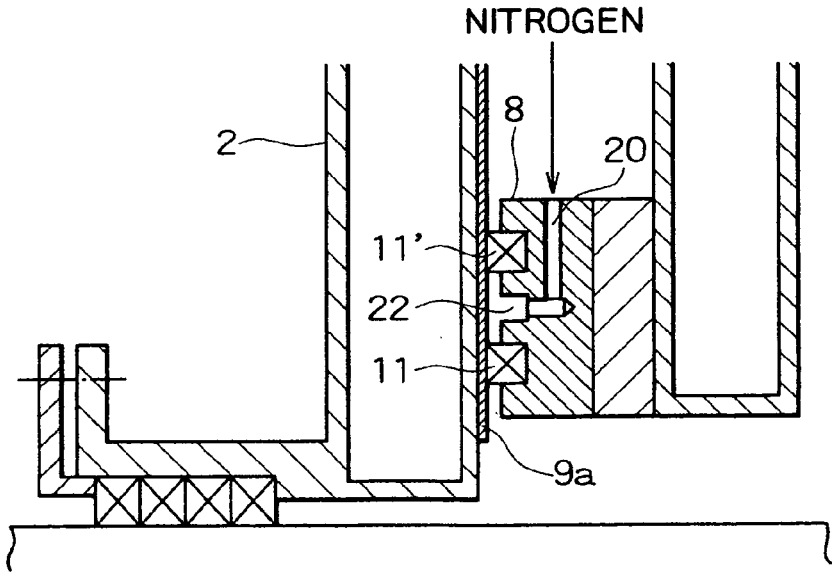
FIG. 7 is a partial vertical sectional view of a sealing structure for a solid-transferring screw according to a seventh embodiment of the present invention.

FIG. 7 illustrates a sealing structure for the solid-transferring screw 3 according to a seventh embodiment of the present invention. In the seventh embodiment, two ring sealing members 11 and 11' are mounted to the sealing block 8, and an inert-gas suction channel 20 is provided for injecting an inert gas into a space between these two sealing members 11 and 11'. The inert-gas suction channel 20 is provided in the sealing block 8.

As shown in FIG. 7, two ring grooves are formed on a face, which faces the contacting face 9*a* of the sliding panel 9, of the sealing block 8. The sealing members 11 and 11' are fitted into the ring grooves, respectively. In this embodiment, the inner sealing member 11 faces the inside of the furnace and the outer sealing member 11' faces the outside of the furnace. An outlet opening 22 of the inert-gas suction channel 20 for blowing the inert gas is formed between the two ring grooves. Pressurized nitrogen is preferably used as an example of the inert gas.

In this seventh embodiment, when the sealing member 11 disposed at the inner side (facing the inside of the furnace) is deteriorated from heat, dust, and the like and when the sealing performance between the sealing member 11 and the contacting face 9*a* of the sliding panel 9 decreases, the pressurized inert gas blows into the furnace through the portion where the sealing performance decreases. As a result, the sealing between the outside and inside of the furnace is retained and the further deterioration of the sealing members 11 and 11' is prevented. In this embodiment, two sealing members 11 and 11' are used, but the number of the sealing member is not limited. Three or more sealing members 11, 11', and the like may be mounted and outlet openings for the inert gas may be arranged at each space between each sealing member 11, 11', and the like.

Other structures, functions, and advantages are the same as those in second embodiment.

[Eight Embodiment]

Figure 8:
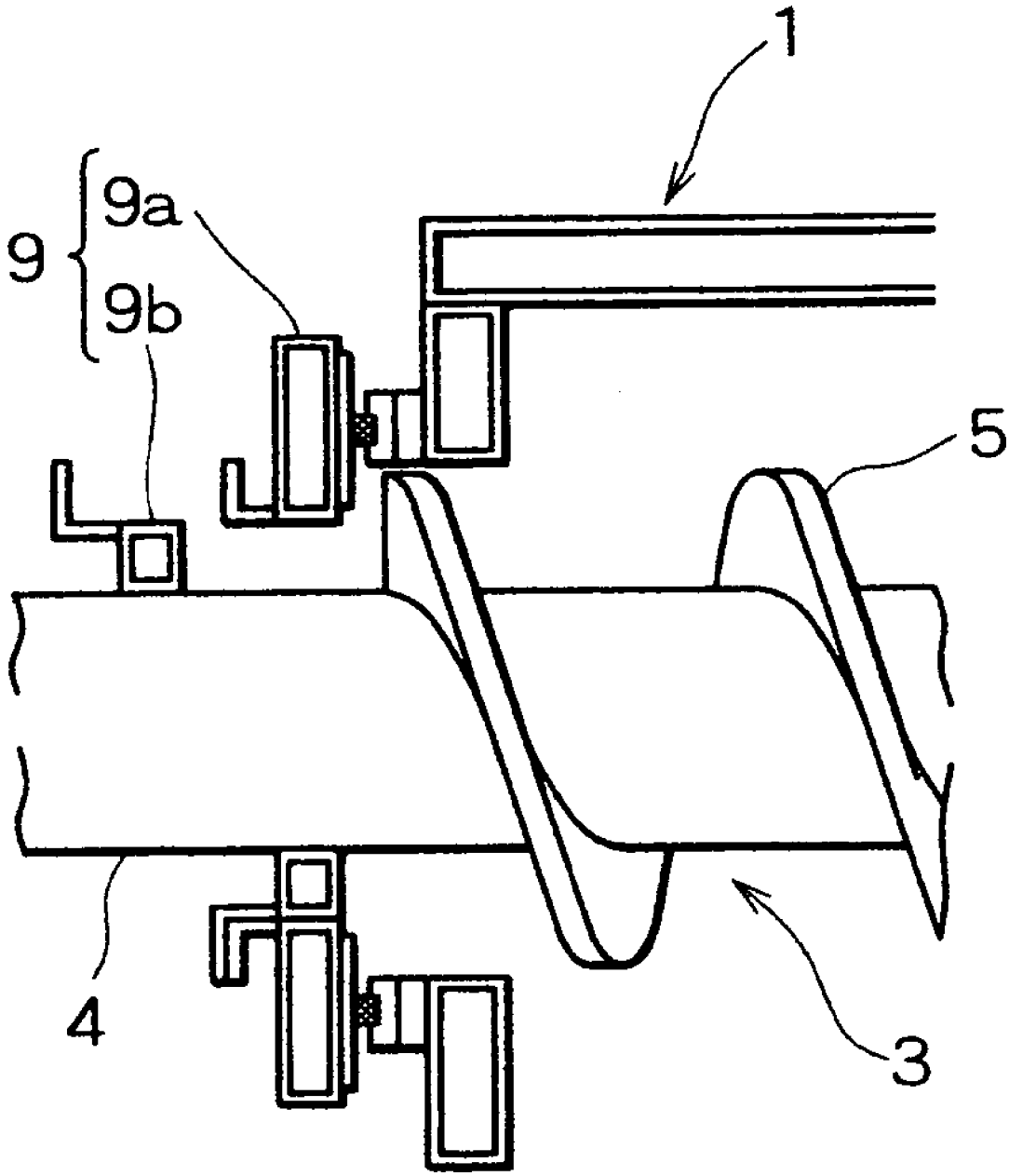
FIG. 8 is a partial vertical sectional view of a sealing structure for a solid-transferring screw according to an eighth embodiment of the present invention.

FIG. 8 illustrates a sealing structure for the solid-transferring screw 3 according to an eighth embodiment of the present invention. The sliding panel 9 in this eighth embodiment consists essentially of a combination of two sliding panel members 9*a* and 9*b*. In the eighth embodiment, since a part of the sliding panel members (sliding panel member 9*b*) is detachable, the solid-transferring screw 3 can be readily extracted from the heating furnace 1 during maintenance work.

As shown in FIG. 8, the inner diameter of the opening of the sliding panel member 9*a* is approximately the same as the outer diameter of the sliding panel member 9*b* and is larger than the outer diameter of the helical blade 5 of the screw 3.

With such a structure, the sliding panel member 9*b* can be detached from the driving shaft and the helical blade 5 of the screw 3 can pass through the opening of the sliding panel member 9*a*. Consequently, the screw 3 can be readily removed from the heating furnace 1.

Therefore, in the eighth embodiment, since maintenance work of the solid-transferring screw 3 can readily be performed, the work hours are reduced and the operating rate is increased.

The sliding panel member 9*b* may be a single ring component, or may be two separate components. With such a separated structure, the sliding panel member 9*b* can be readily attached to and removed from the driving shaft 4 of the screw 3. Consequently, the workability further increases.

Other structures, functions, and advantages are the same as the first embodiment.

[Ninth Embodiment]

Figure 9:
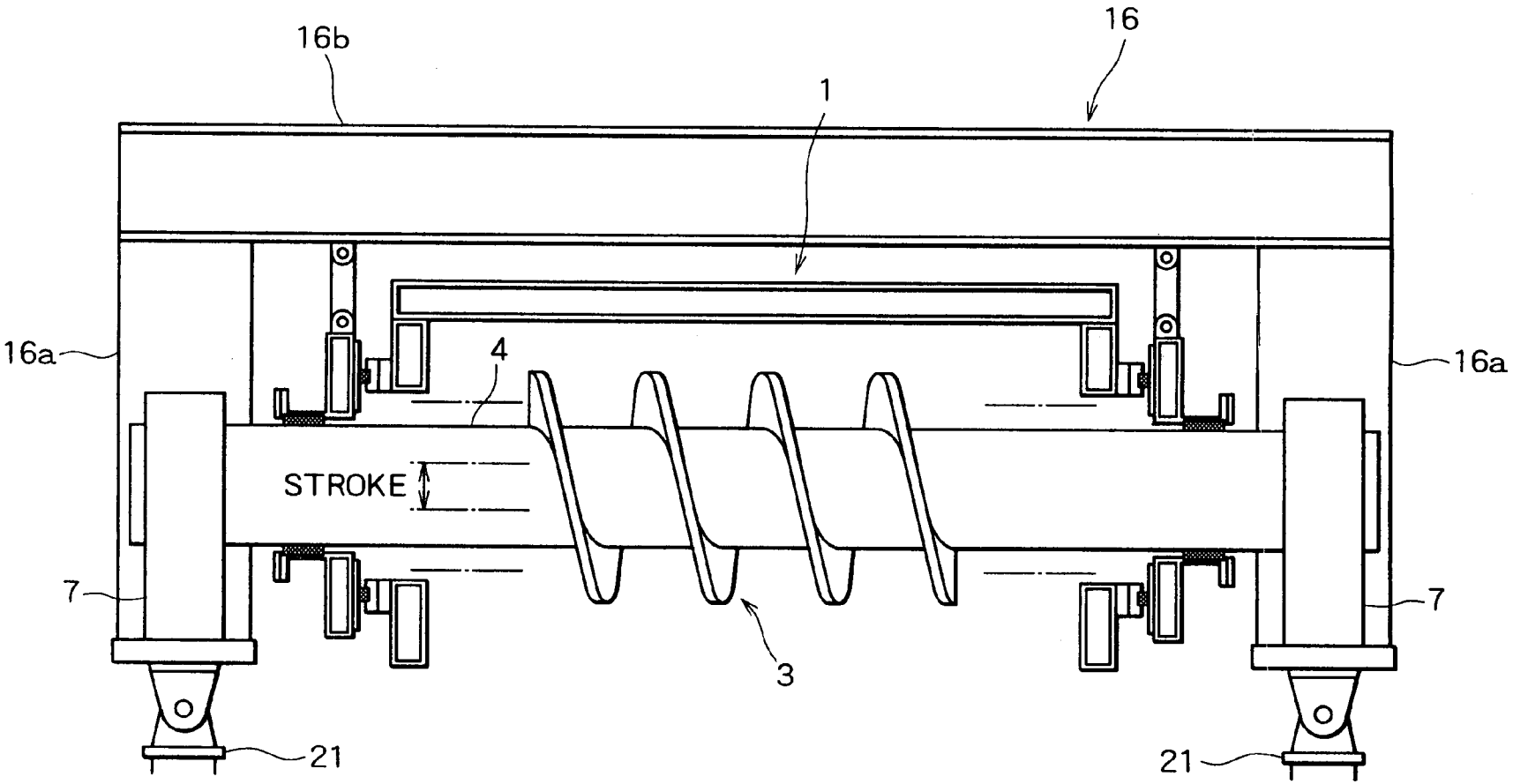
FIG. 9 is a partial vertical sectional view of a sealing structure for a solid-transferring screw according to a ninth embodiment of the present invention.

FIG. 9 illustrates a sealing structure for the solid-transferring screw 3 according to a ninth embodiment of the present invention. In the ninth embodiment, the lifting members 16, which are disposed at both the sides of the heating furnace 1 as shown, for example, in FIG. 3 illustrating the third Embodiment, are integrated with each other.

As shown in FIG. 9, preferably, the lifting members 16 at both the sides of the furnace are integrated by the transverse member 16*b*. The longitudinal members 16*a* are connected with both the ends of the transverse member 16*b* to form a gate-shaped lifting member 16.

The supporting device 7 and lift actuator 21 are connected with a pin. Preferably, the pin extends through a pin insertion hole that has an elliptic shape with a larger diameter in the horizontal direction. With such a structure, even when the driving shaft 4 of the solid-transferring screw 3 inclines and a horizontal distance between the supporting devices 7 at the two sides (between the shaft bearings at the two sides) changes, the change in the horizontal distance between the two supporting devices can be absorbed by the connecting structure of the two lift actuators 21.

Therefore, in the ninth embodiment, since the driving shaft 4 and the supporting devices 7 of the driving shaft 4 disposed at both the outer sides of the furnace integrally move, the supporting devices 7 are not significantly loaded even when the driving shaft 4 of the solid-transferring screw 3 inclines from the horizontal position.

Other structures, functions, and advantages are the same as the third embodiment.

INDUSTRIAL APPLICABILITY

As described above, the present invention can be applied to seal gaps between through-holes for a screw-driving shaft of a heating furnace and a liftable solid-transferring screw provided in the heating furnace for heating solid materials.

The invention claimed is:

1. A sealing structure which seals gaps between a heating furnace for heating a solid material and a liftable solid-transferring screw extending through side walls of the heating furnace, wherein the solid-transferring screw has a driving shaft substantially horizontally arranged and a helical blade fixed on the driving shaft;

the driving shaft passes through through-holes for screw-driving shaft which are formed in the side walls of the heating furnace, each of the through-holes having a vertical size which is larger than the diameter of the driving shaft by at least a lifting range of the solid-transferring screw, the driving shaft being supported by liftable supporting devices which are disposed at the outsides of the heating furnace;

sealing blocks are attached on the outer edges of the through-holes for the screw-driving shaft so as to surround the periphery of the through-holes at the outsides of the heating furnace; and sliding panels are disposed at the outer sides of the sealing blocks of the furnace, each of the sliding panels having a sliding hole for sliding the screw-driving shaft so that the driving shaft extends through the sliding hole, each of the sliding panels being slidable in the vertical direction while airtightness between the sliding panel and the sealing block is retained.

2. The sealing structure for the solid-transferring screw according to claim 1, further comprising at least one sealing member that surrounds the driving shaft between the corresponding sealing block and the corresponding sliding panel, wherein the sliding panel is brought into contact with the sealing block with the sealing member therebetween.

3. The sealing structure for the solid-transferring screw according to claim 2, wherein two or more sealing members are provided and at least one inert-gas suction channel for injecting inert gas is disposed between these sealing members.

4. The sealing structure for the solid-transferring screw according to claim 1, further comprising sealing devices for sealing gaps between the driving shaft and the sliding holes for sliding the screw-driving shaft.

5. The sealing structure for the solid-transferring screw according to claim 4, wherein the sealing devices and the sliding panels are connected with respective expansion joints.

6. The sealing structure for the solid-transferring screw according to claim 1, further comprising lifting members and couplers disposed at the outsides of the heating furnace, wherein each of the lifting members is fixed on the corresponding supporting device and cooperatively moves up and down with the supporting device, and each of the couplers connects the corresponding lifting member and the corresponding sliding panel.

7. The sealing structure for the solid-transferring screw according to claim 6, wherein each of the couplers is pivoted to the corresponding lifting member and the corresponding sliding panel.

8. The sealing structure for the solid-transferring screw according to claim 7, wherein the lifting members disposed at the outsides of the heating furnace are integrated with each other.

9. The sealing structure for the solid-transferring screw according to claim 6, wherein the lifting members disposed at the outsides of the heating furnace are integrated with each other.

10. The sealing structure for the solid-transferring screw according to claim 1, further comprising biasing devices for biasing the sliding panels to the sealing blocks.

11. The sealing structure for the solid-transferring screw according to claim 1, wherein each of the sliding panels comprises a combination of a plurality of sliding panel members so that the solid-transferring screw can be extracted from the furnace by removing a part of the sliding panel members.

12. A method for producing a reduced metal by heating and reducing a metal oxide containing a carbonaceous reducing material, comprising the steps of;

feeding the metal oxide into a heating furnace for heating the metal oxide;

leveling the metal oxide fed into the heating furnace in the feeding step with a material-leveling screw; and heating the metal oxide evenly laid in the leveling step for reducing; wherein the material-leveling screw comprises a driving shaft and a helical blade fixed on the driving shaft;

the driving shaft passes through through-holes for screw-driving shaft which are formed in the side walls of the heating furnace, each of the through-holes having a vertical size which is larger than the diameter of the driving shaft by at least a lifting range of the solid-transferring screw, the driving shaft being supported by liftable supporting devices which are disposed at the outsides of the heating furnace;

sealing blocks are attached on the outer edges of the through-holes for the screw-driving shaft so as to surround the periphery of the through-holes at the outsides of the heating furnace; and sliding panels are disposed at the outer sides of the sealing blocks of the furnace, each of the sliding panels having a sliding hole for sliding the screw-driving shaft so that the driving shaft extends through the sliding hole, each of the sliding panels being slidable in the vertical direction while airtightness between the sliding panel and the sealing block is retained.

13. A method for producing a reduced metal by heating and reducing a metal oxide containing a carbonaceous reducing material, comprising the steps of:

feeding the metal oxide into a heating furnace for heating the metal oxide;

heating the metal oxide fed into the heating furnace in the feeding step for reducing; and discharging the resulting reduced metal in the heating step with a product-discharging screw;

wherein the product-discharging screw comprises a driving shaft and a helical blade fixed on the driving shaft;

the driving shaft passes through through-holes for screw-driving shaft which are formed in the side walls of the heating furnace, each of the through-holes having a vertical size which is larger than the diameter of the driving shaft by at least a lifting range of the solid-transferring screw, the driving shaft being supported by liftable supporting devices which are disposed at the outsides of the heating furnace;

sealing blocks are attached on the outer edges of the through-holes for the screw-driving shaft so as to surround the periphery of the through-holes at the outsides of the heating furnace; and sliding panels are disposed at the outer sides of the sealing blocks of the furnace, each of the sliding panels having a sliding hole for sliding the screw-driving shaft so that the driving shaft extends through the sliding hole, each of the sliding panels being slidable in the vertical direction while airtightness between the sliding panel and the sealing block is retained.

* * * * *

UNITED STATES PATENT AND TRADEMARK OFFICE

CERTIFICATE OF CORRECTION

PATENT NO. : 7,204,689 B2
APPLICATION NO. : 10/542637
DATED : April 17, 2007
INVENTOR(S) : Hashimoto et al.

It is certified that error appears in the above-identified patent and that said Letters Patent is hereby corrected as shown below:

On the title page, Item (73), the assignee is incorrect. Item (73) should read:
-- (73) Assignee: Kabushiki Kaisha Kobe Seiko Sho (Kobe Steel, Ltd.)
Kobe-shi, (JP) --

Signed and Sealed this

First Day of January, 2008

JON W. DUDAS
*Director of the United States Patent and Trademark Office*